US010920398B2

(12) United States Patent
Cashman et al.

(10) Patent No.: US 10,920,398 B2
(45) **Date of Patent: *Feb. 16, 2021**

(54) CAROUSELING ARTICULATED DREDGE AND BARGE

(71) Applicant: Cashman Dredging & Marine Contracting Co., LLC, Quincy, MA (US)

(72) Inventors: Jay Cashman, Quincy, MA (US); Bradford Wallace, Quincy, MA (US); Frank J. Belesimo, Quincy, MA (US)

(73) Assignee: Cashman Dredging & Marine Contracting Co., LLC, Quincy, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/233,441

(22) Filed: Dec. 27, 2018

(65) Prior Publication Data

US 2019/0218748 A1 Jul. 18, 2019

Related U.S. Application Data

(63) Continuation of application No. 15/869,118, filed on Jan. 12, 2018, now Pat. No. 10,167,609.

(51) Int. Cl.
*E02F 3/92* (2006.01)
*E02F 5/00* (2006.01)
(Continued)

(52) U.S. Cl.
CPC ..... *E02F 3/9243* (2013.01); *E02F 3/8841* (2013.01); *E02F 3/905* (2013.01);
(Continued)

(58) Field of Classification Search
CPC ..... E02F 3/9243; E02F 3/8841; E02F 3/905; E02F 3/9293; E02F 5/006; E02F 7/04; E02F 7/10
See application file for complete search history.

(56) References Cited

U.S. PATENT DOCUMENTS 477,827 A 6/1892 Souther
660,956 A 10/1900 Henderson
(Continued)

FOREIGN PATENT DOCUMENTS

CN 203307860 U 11/2013
CN 203546806 U 4/2014
(Continued)

*Primary Examiner* — Jamie L McGowan
(74) *Attorney, Agent, or Firm* — Pierce Atwood LLP; Kevin M. Farrell; Christopher A. Baxter

(57) ABSTRACT

A vessel and vessel/barge systems for dredging underwater surfaces. The vessel includes a hull with a bottom, bow portion, stern portion, port side, and starboard side. The vessel also includes a deck supported by the hull and a pump system mounted within the hull. A drag arm pivotably couples to the pump system. The vessel additionally includes a void defined by contiguous watertight walls or bulkheads joined to and extending upward from the bottom of the hull. The contiguous watertight walls or bulkheads are (i) vertically extensive of a perimeters of an aperture in the bottom of the hull, (ii) outboard, astern, and forward the aperture, or (iii) some combination thereof. The barge is releasably coupled to the vessel. Moreover, the barge is in fluidic communication with the drag arm.

23 Claims, 11 Drawing Sheets

(51) Int. Cl.

| | |
|---|---|
| ***E02F 3/88*** | (2006.01) |
| ***E02F 7/10*** | (2006.01) |
| ***E02F 3/90*** | (2006.01) |
| ***E02F 7/04*** | (2006.01) |

(52) U.S. Cl.
CPC ..... *E02F 3/9293* (2013.01); *E02F 5/006* (2013.01); *E02F 7/04* (2013.01); *E02F 7/10* (2013.01)

(56) References Cited

U.S. PATENT DOCUMENTS

| | | | |
|---|---|---|---|
| 3,429,062 | A | 2/1969 | Nelson |
| 3,512,280 | A | 5/1970 | Pema |
| 3,521,387 | A | 7/1970 | Degelman |
| 3,739,503 | A | 6/1973 | Barker et al. |
| 3,820,258 | A | 6/1974 | Fahrner |
| 3,919,790 | A | 11/1975 | Sasaki et al. |
| 3,950,030 | A | 4/1976 | Girden |
| 3,962,803 | A | 6/1976 | O'Brien |
| 3,975,842 | A | 8/1976 | Andreae |
| 4,095,545 | A | 6/1978 | Vaughn et al. |
| 4,212,121 | A | 7/1980 | Kato et al. |
| 4,267,652 | A | 5/1981 | Senesac |
| 4,505,214 | A | 3/1985 | Tjebbes et al. |
| 4,896,445 | A | 1/1990 | Deal |
| 4,903,419 | A | 2/1990 | Nishikawa |
| 5,173,182 | A | 12/1992 | Debellian |
| 5,603,171 | A | 2/1997 | Steinkuhler |
| 5,791,074 | A | 8/1998 | Pryor |
| 6,189,243 | B1 | 2/2001 | Oikawa |
| 7,793,441 | B2 | 9/2010 | Clymans |
| 7,895,775 | B2 | 3/2011 | Tack |
| 8,056,270 | B1 | 11/2011 | Maitlen et al. |
| 8,127,474 | B2 | 3/2012 | Phillips |
| 9,061,742 | B2 | 6/2015 | Becker et al. |
| 9,476,181 | B2 | 10/2016 | Tack |

FOREIGN PATENT DOCUMENTS

| | | | |
|---|---|---|---|
| JP | 2016132895 | A | 7/2016 |
| WO | 9521303 | | 8/1995 |
| WO | 2016055119 | A1 | 4/2016 |
| WO | 2016097455 | A1 | 6/2016 |

CAROUSELING ARTICULATED DREDGE AND BARGE

BACKGROUND

Dredging refers to the removal of material from a bed of a waterway (e.g., a harbor, river, or other area of water) to increase water depth and/or widen the waterway to make or keep the waterway navigable. Sometimes, material removed from a waterway (i.e., dredge) is used to replenish beaches and other coastal areas.

One type of dredging is known as trailing suction dredging. Trailing suction dredging involves a vessel that includes a suction pipe fitted with a drag head. As the vessel navigates a waterway, the drag head is dragged along or proximate to the waterway's bed. Dredge that is gathered by the drag head is sent through the drag pipe to storage, oftentimes a hopper.

SUMMARY

The present disclosure provides a dredging vessel and barge system outfitted to improve trailing suction dredging. A dredging vessel according to the present disclosure includes a "moonpool," which is one or more apertures located through the dredging vessel, via which improved maneuverability of the dredge head is achieved.

The present disclosure provides a carouseling system. A dredging vessel may fill a barge with dredging spoils. The dredging vessel may uncouple from the full barge and connect to a readily available empty barge. This allows the dredging vessel to continuously (or substantially continuously) dredge an underwater surface without significant downtime, such as that experienced by dredging vessels fitted with hoppers, which need to stop dredging to unload a full hopper.

One aspect of the present disclosure relates to a dredging system including a vessel. The vessel includes a hull with a bottom, bow portion, stern portion, port side, and starboard side. The vessel also includes a deck supported by the hull and a pump system mounted within the hull. A drag arm pivotably couples to the pump system. The vessel additionally includes a void defined by contiguous watertight walls or bulkheads joined to and extending upward from the bottom of the hull. The contiguous watertight walls or bulkheads are (i) vertically extensive of a perimeters of an aperture in the bottom of the hull, (ii) outboard, astern, and forward the aperture, or (iii) some combination thereof. The barge is releasably coupled to the vessel. Moreover, the barge is in fluidic communication with the drag arm.

Another aspect of the present disclosure relates to a dredging system including a vessel and a barge. The vessel includes a hull with a bottom, bow portion, stern portion, port side, and starboard side. The vessel also includes a deck supported by the hull and a pump system mounted within the hull. A drag arm pivotably couples to the pump system. The vessel additionally includes a void defined by contiguous watertight walls or bulkheads joined to and extending upward from the bottom of the hull. The contiguous watertight walls or bulkheads are (i) vertically extensive of a perimeters of an aperture in the bottom of the hull, (ii) outboard, astern, and forward the aperture, or (iii) some combination thereof. The barge is releasably coupled to the vessel. Moreover, the barge is in fluidic communication with the drag arm.

BRIEF DESCRIPTION OF DRAWINGS

For a more complete understanding of the present disclosure, reference is now made to the following description taken in conjunction with the accompanying drawings.

DETAILED DESCRIPTION

Figure 1:
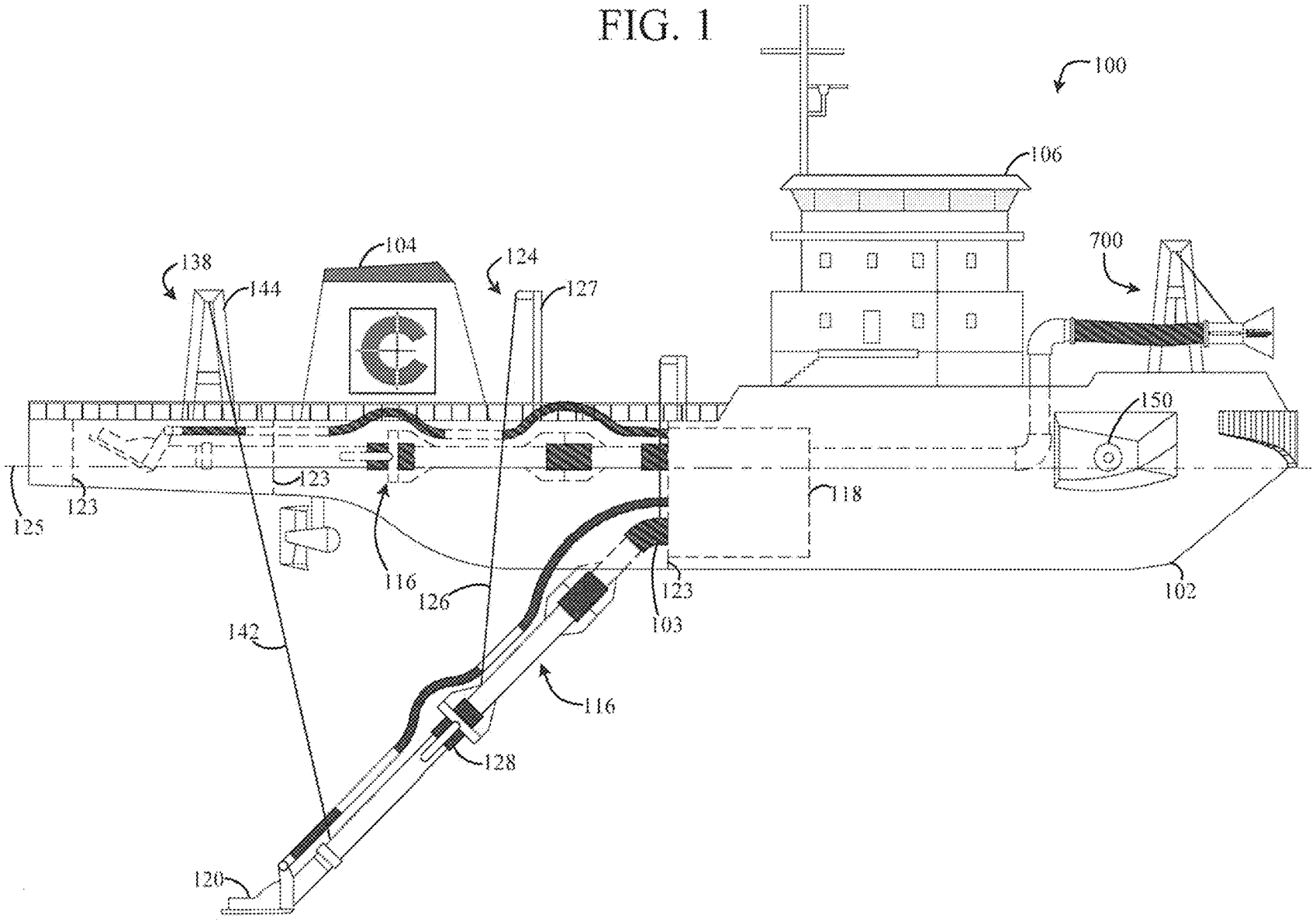
FIG. 1 is a side view of a dredging vessel with a drag arm in a lowered, dredging position according to embodiments of the present disclosure.
Figure 2:
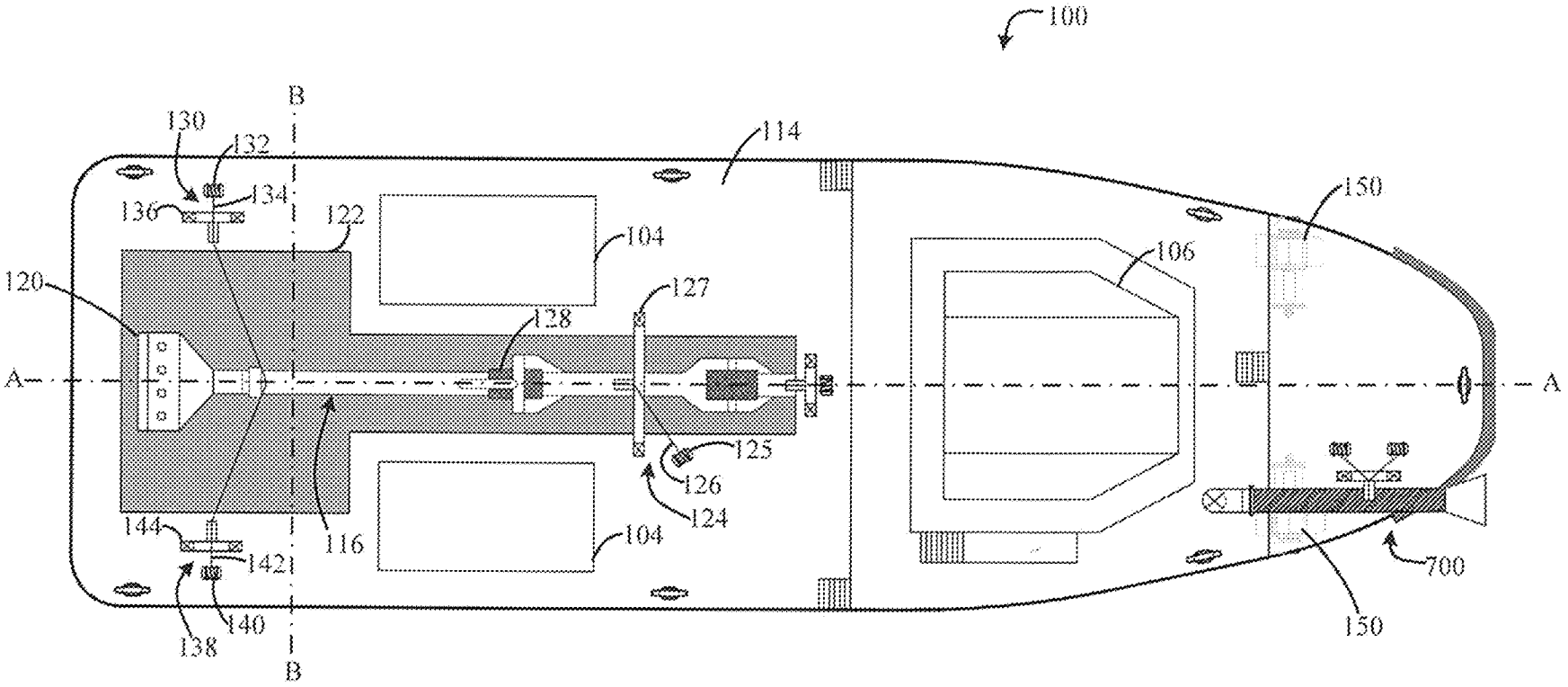
FIG. 2 is a top view of a dredging vessel according to embodiments of the present disclosure.
Figure 3:
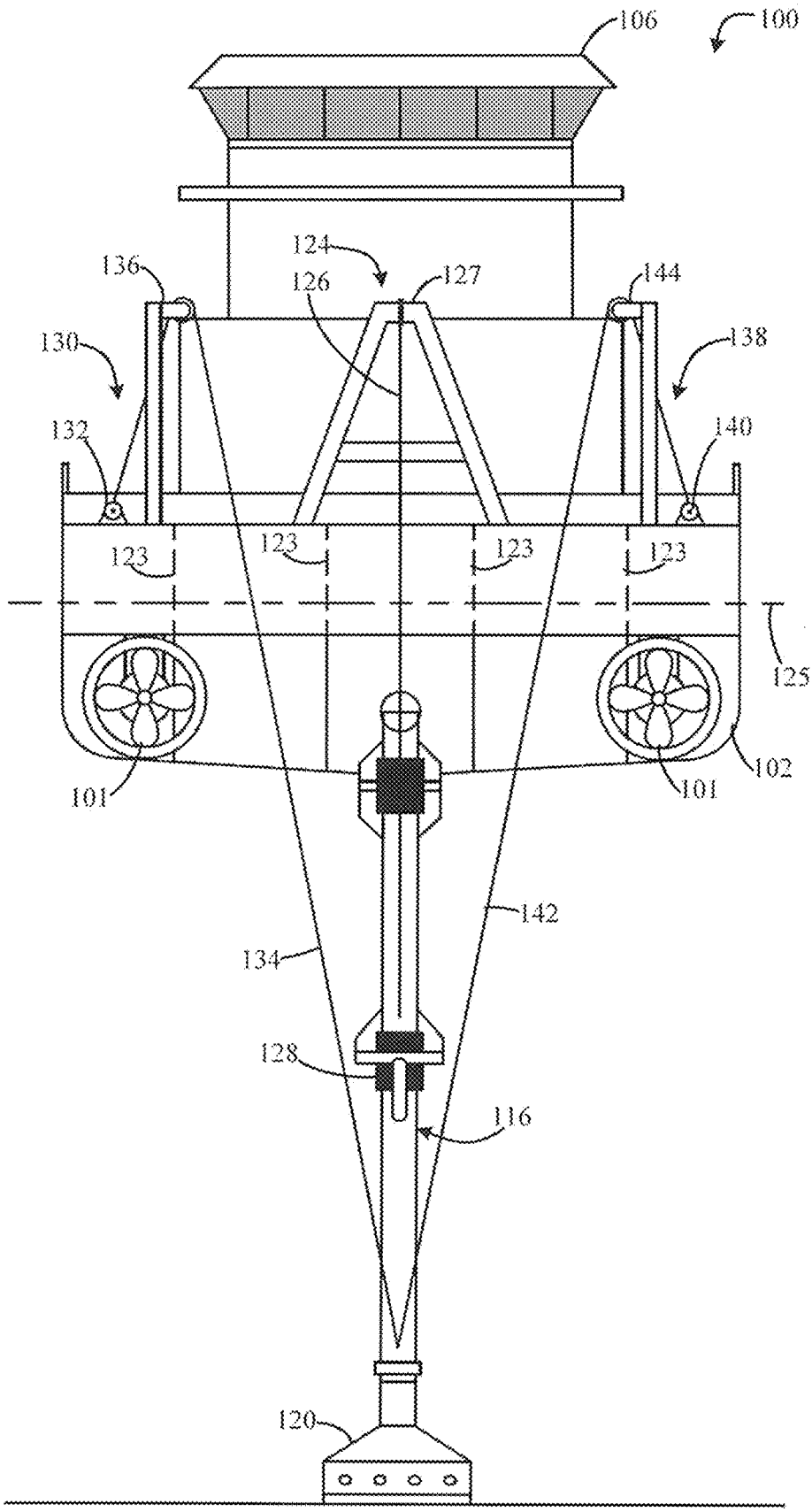
FIG. 3 is a rear view of a dredging vessel with a drag arm in a lowered, dredging position according to embodiments of the present disclosure.

FIGS. 1 through 3 illustrate a dredging vessel 100 according to the present disclosure. The dredging vessel 100 includes a hull 102 that supports a deck 114. The hull 102 includes a bottom, a bow portion, a stern portion, a port side, and a starboard side. The deck 114 may support a wheel house 106. The dredging vessel 100 further includes at least one engine compartment 104. The engine compartment(s) 104 may include machinery that propels the dredging vessel 100 using, for example, one or more propellers 101. The engine compartment(s) 104 may be located above the deck 114 (as illustrated) or may be located below the deck 114.

The dredging vessel 100 may include a dredging system including a pump room 118, a drag arm 116, and a drag head 120. The pump room 118 includes machinery (e.g., a pump system, not shown) that causes the drag head 120 to gather dredge from an underwater surface. The gathered dredge is passed through the drag arm 116 to a storage unit (e.g., a hopper or a barge as described herein below). Preferably, the dredging vessel 100 is hopperless.

The hull 102 of the dredging vessel 100 includes an aperture 122 that allows for observation, control, and protection of the drag arm 116, as well as centralized weight distribution of the dredging vessel 100. Moreover, the hull 102 of the dredging vessel 100 may include contiguous watertight walls (e.g., bulkheads), whose edges are represented by dashed lines 123, that join to and extend upward from the bottom of the hull 102, thereby defining a void. The contiguous watertight walls 123 may be (i) vertically extensive of a perimeter of the aperture 122 located in the bottom of the hull 102, (ii) outboard, astern, and forward the aperture 122, or (iii) some combination thereof. The contiguous watertight walls may extend completely between the bottom of the hull 102 and the deck 114. Alternatively, the contiguous watertight walls may connect to the bottom of the hull 120 and partly extend towards the deck 114 (e.g., may extend above a waterline 125 experienced by the vessel 100 but not all the way to the deck 114). The aperture 122 and/or the void, defined by the contiguous watertight walls, may be referred to as a "moonpool."

The aperture 122 and/or the void may be centrally located about a bow-stern axis A-A of the dredging vessel 100 such that the bow-stern axis A-A creates an axis of symmetry that divides the aperture 122 and/or the void into two congruent halves. The aperture 122 and/or the void may also substantially or wholly be located in the stern portion of the dredging vessel 100.

The aperture 122 and/or the void may include a first elongated portion that extends parallel with the bow-stern axis A-A of the dredging vessel 100. The first elongated portion enables the drag arm to be raised and lowered as discussed herein below. The aperture 122 and/or the void may also include a second elongated portion that extends parallel with a port-starboard axis B-B of the dredging vessel 100. The second elongated portion enables motion of the drag arm to be controlled as well as the drag arm to be raised and lowered, as discussed herein below. The second elongated portion may be located at a backmost portion of the dredging vessel 100 such that the aperture 122 and/or the void forms a "T" structure.

The drag arm 116 may be pivotally coupled to the pump system (not shown) in the pump room 118 via a first flexible joint 103. The drag arm 116 may pivot or slide between a lowered position (illustrated by solid lines in FIG. 1) and a raised position (illustrated by dashed lines in FIG. 1). The lowered position may be considered an active dredging position. The aperture 122 and/or the void may accommodate pivoting of the drag arm 116 from the lowered position to the raised position. The void, defined by the contiguous watertight walls in the hull 102, may act as a drag arm containment zone in that at least part of the drag arm 116 and at least part of the drag head 120 may reside within the void when the drag arm 116 is in the raised position.

The dredging vessel 100 may include a mechanism 124 for raising and lowering the drag arm 116. The mechanism 124 may include a davit winch 125 including a wire 126 that runs through an A-frame (or other shaped) structure 127 and that couples to the drag arm 116. The wire 126 may extend through the deck 114 (or an aperture therein), through the void, and through the aperture 122 when the drag arm 116 is in the lowered position. The wire 126 may extend through the deck 114 (or an aperture therein) and may extend partially (if at all) through the void when the drag arm 116 is in the raised position.

The deck may be configured to facilitate control of wires as described herein. The deck 114 may be substantially open such that the wires do not pass through any particular aperture in the deck 114. Alternatively, as illustrated in FIG. 2, the deck 114 may include an aperture similar to the aperture 122 located in the hull 102 (e.g., the aperture in the deck 114 may include a first elongated portion that extends parallel with the bow-stern axis A-A of the dredging vessel 100 and/or a second elongated portion that extends parallel with a port-starboard axis B-B of the dredging vessel 100.

The drag arm 116 may include a second flexible joint 128. The second flexible joint 128, and other flexible joints of the drag arm 116 including by not limited to the first flexible joint 103, may be a commercially available flexible joint, such as that offered by Royal IHC, located in the Netherlands. The wire 126 may couple to the flexible joint 128 or proximate to the flexible joint 128 such that raising of the drag arm 114 by the mechanism 124 at least partially causes the drag head 120 to experience an increased angle of dredging. Conversely, lowering of the drag arm 114 by the mechanism 124 may at least partially cause the drag head 120 to experience a decreased angle of dredging.

The dredging vessel 100 also includes a port control mechanism 130 located on the port side of the dredging vessel 100. The port control mechanism 130 may be located on the deck 114, proximate to a second elongated portion of an aperture of the deck 114 if the deck 114 is so configured. The port control mechanism 130 may include a davit winch 132 including a wire 134 that runs through an A-frame (or other shaped) structure 136 and that couples to the drag arm 116 proximate to the drag head 120. The wire 134 may extend through the deck 114 (or an aperture therein), through the void, and through the aperture 122 when the drag arm 116 is in the lowered position. The wire 134 may extend through the deck 114 (or an aperture therein) and may extend partially (if at all) through the void when the drag arm 116 is in the raised position. Depending on the port-starboard orientation of the drag arm 116, the wire 134 may extend through a port portion of the aperture 122 and the void (and a corresponding aperture in the deck 114 if the deck 114 is so configured).

The dredging vessel 100 also includes a starboard control mechanism 138 located on the starboard side of the dredging vessel 100. The starboard control mechanism 138 may be located on the deck 114, proximate to a second elongated portion of an aperture of the deck 114 if the deck 114 is so configured. The starboard control mechanism 138 may include a davit winch 140 including a wire 142 that runs through an A-frame (or other shaped) structure 144 and that couples to the drag arm 116 proximate to the drag head 120. The wire 142 of the starboard control mechanism 138 may couple to the drag arm 116 at the same location or proximate to the same location as the wire 134 of the port control mechanism 130. The wire 142 may extend through the deck 114 (or an aperture therein), through the void, and through the aperture 122 when the drag arm 116 is in the lowered position. The wire 142 may extend through the deck 114 (or an aperture therein) and may extend partially (if at all) through the void when the drag arm 116 is in the raised position. Depending on the port-starboard orientation of the drag arm 116, the wire 142 may extend through a starboard portion of the aperture 122 and the void (and a corresponding aperture in the deck 114 if the deck 114 is so configured).

The port control mechanism 130 and the starboard control mechanism 138 may collaboratively be operated to control a location of the drag head 120 along an underwater surface. Moreover, the port control mechanism 130 and the starboard control mechanism 138 may be operated to maneuver the drag arm 116 and drag head 120 between the raised and lowered positions.

The dredging vessel 100 may also include components of one or more articulated tub/barge (AT/B) connectors 150 that couple the dredging vessel 100 to a barge as discussed herein below. The dredging vessel 100 may include a port-bow AT/B connector and a starboard-bow AT/B connector. A commercially available AT/B may be used, such as an Articouple system provided by Taisei Engineering Consultants, Inc.

Figure 4:
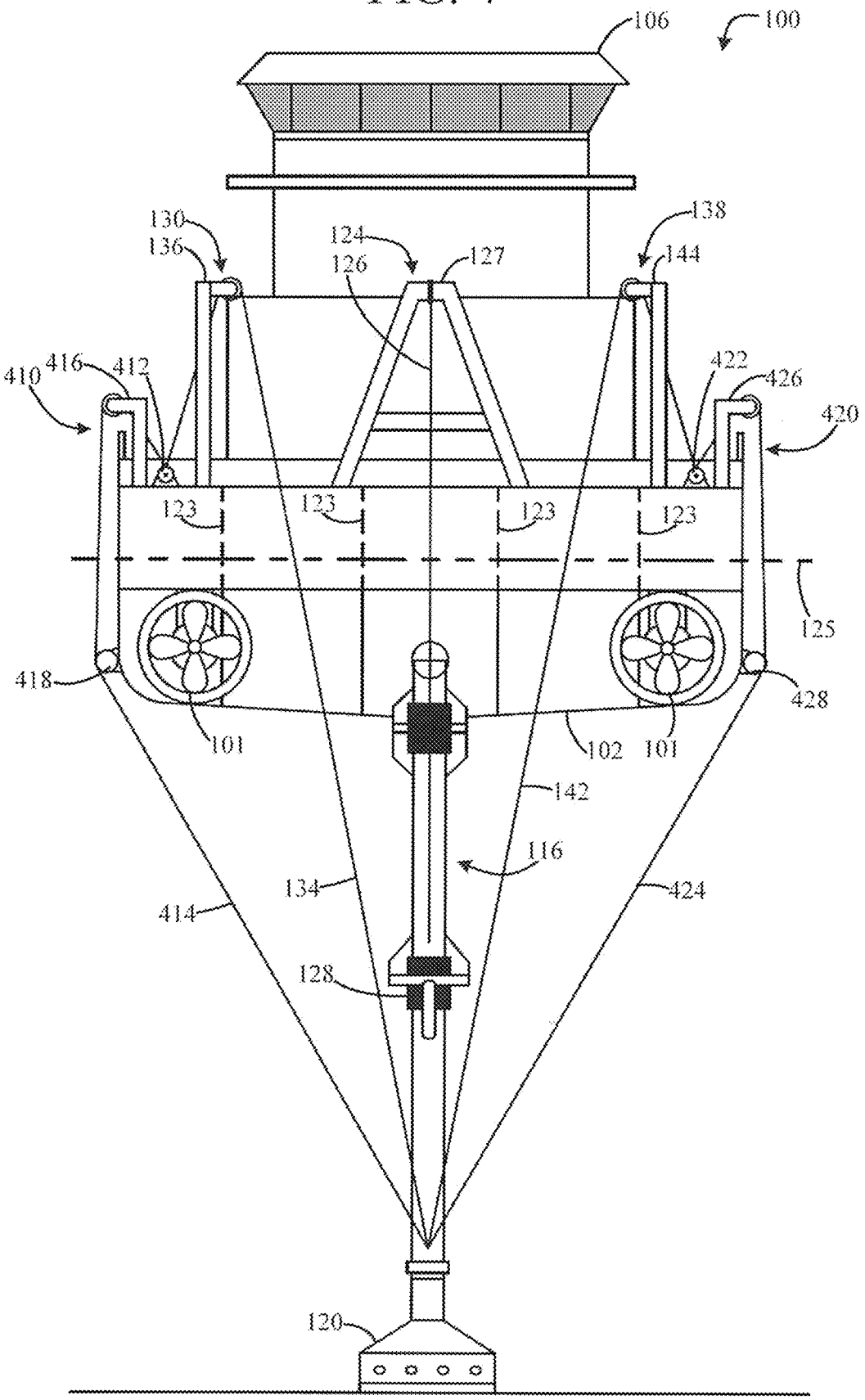
FIG. 4 is a rear view of a dredging vessel with a drag arm in a lowered, dredging position according to embodiments of the present disclosure.

FIG. 4 illustrates the dredging vessel 100 that includes a second port control mechanism 410 and a second starboard control mechanism 420. While FIG. 4 illustrates the dredging vessel 100 includes the port control mechanism 130, the second port control mechanism 410, the starboard control mechanism 138, and the second starboard control mechanism 420, one skilled in the art will appreciate that the dredging vessel 100 may include various combinations of, but not all of the port control mechanism 130, the second port control mechanism 410, the starboard control mechanism 138, and the second starboard control mechanism 420. In an example, the dredging vessel 100 may include the second port control mechanism 410 and the second starboard control mechanism 420, and not the port control mechanism 130 or the starboard control mechanism 138.

The second port control mechanism 410 may be located on the deck 114, proximate to the port control mechanism 130 if also implemented. The second port control mechanism 410 may include a davit winch 412 including a wire 414 that runs through an A-frame (or other shaped) structure 416 and one or more pulleys 416 located on an outer surface of the hull 102. The wire 414 may couple to the drag arm 116 proximate to the drag head 120 (e.g., at a same or different location as the wires 134, 142.

The second starboard control mechanism 420 may be located on the deck 114, proximate to the starboard control mechanism 130 if also implemented. The second starboard control mechanism 138 may include a davit winch 422 including a wire 424 that runs through an A-frame (or other shaped) structure 426 and one or more pulleys 428 located on an outer surface of the hull 102. The wire 428 may couple to the drag arm 116 proximate to the drag head 120 (e.g., at a same or different location as the wires 134, 142, 414.

Figure 5:
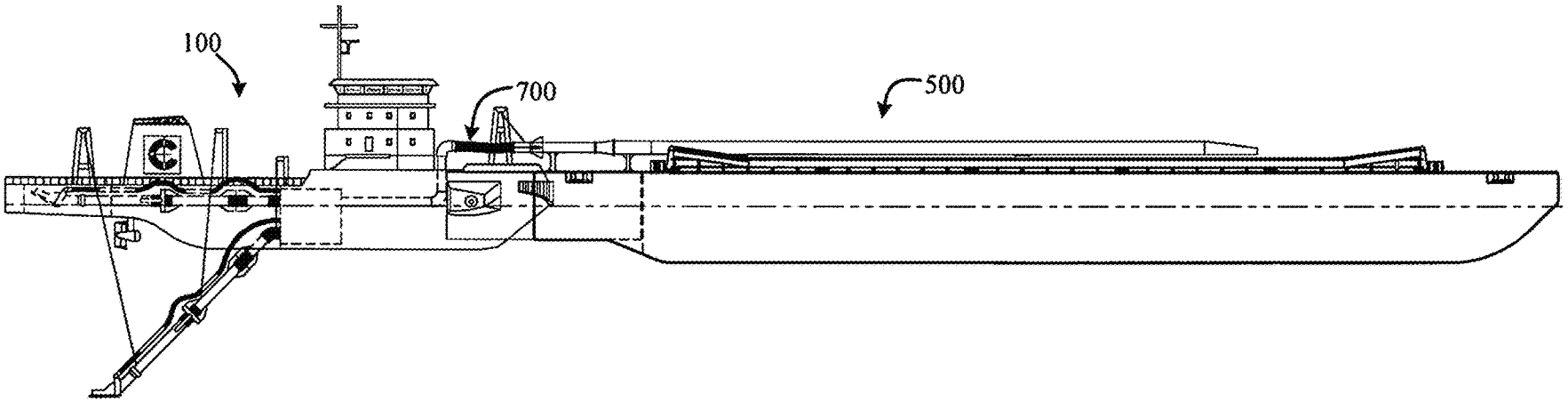
FIG. 5 is a side view of a dredging system including a dredging vessel and a barge according to embodiments of the present disclosure.
Figure 6:
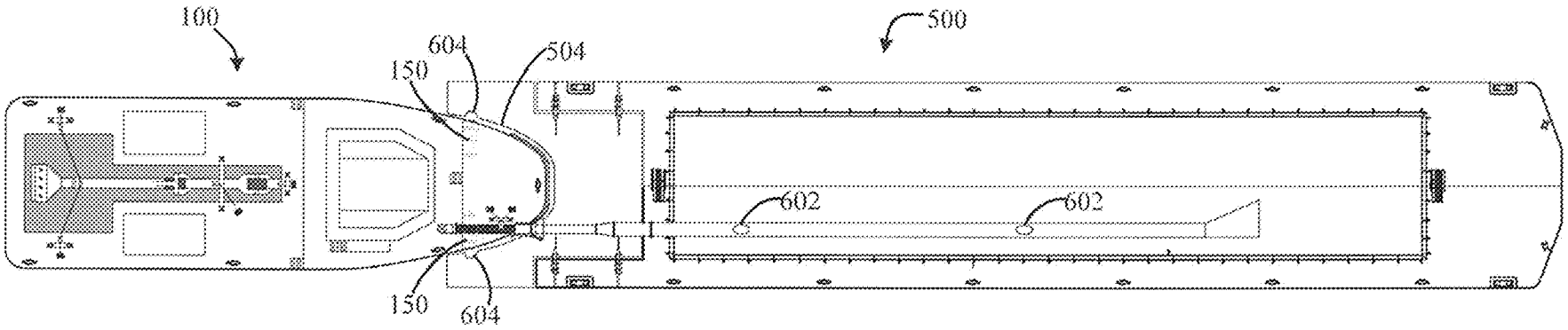
FIG. 6 is a top view of a dredging system including a dredging vessel and a barge according to embodiments of the present disclosure.

FIGS. 5 and 6 illustrate a dredging system including the dredging vessel 100 and a barge 500 according to the present disclosure. The barge 500 releasably couples to the vessel 100, for example using at least one AT/B connector 150. The dredging vessel 100 may include the AT/B connector 150 and the barge 500 may include an AT/B pin receiving portion 604.

The bow portion of the vessel 100 may couple to a stern portion of the barge 500 such that the vessel 100 may maneuver the barge 400. The stern portion of the barge 500 may include a concave portion or recess 504. The concave portion 504 may be configured with a size and/or shape that enables the concave portion 504 to receive the convex bow portion of the vessel 100.

When the barge 500 is coupled to the vessel 100, the barge 500 is in fluidic communication with the drag arm 116 such that dredge gathered by the drag head 120 is passed through the drag arm 116, and optionally other intermediary components, to the barge 500. Various approaches may be used to render the barge 500 in fluidic communication with the drag arm 116.

Figure 7:
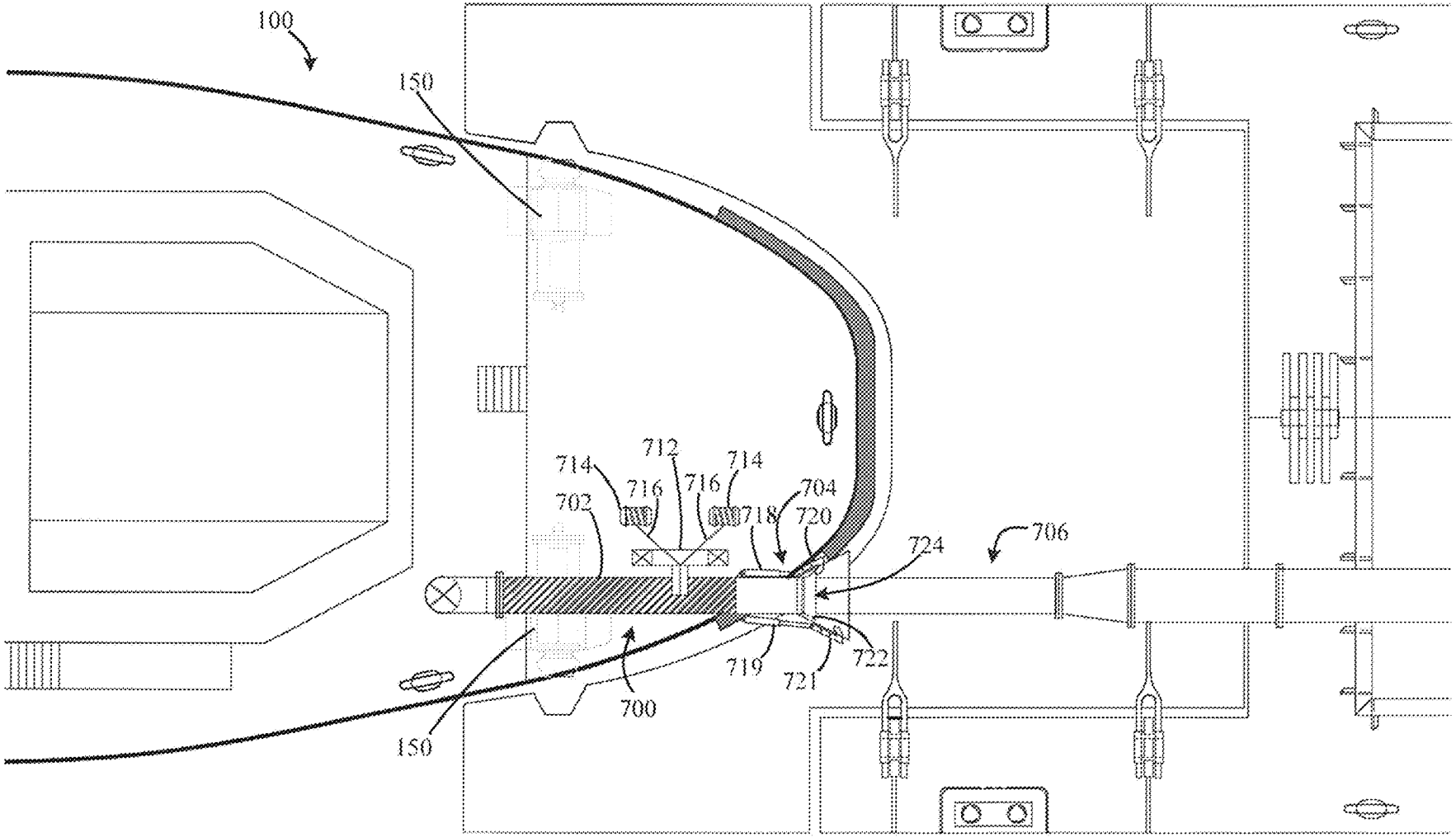
FIG. 7 is a top view of a dredging system including a first means for transporting dredge from a dredging vessel to a barge according to embodiments of the present disclosure.
Figure 8:
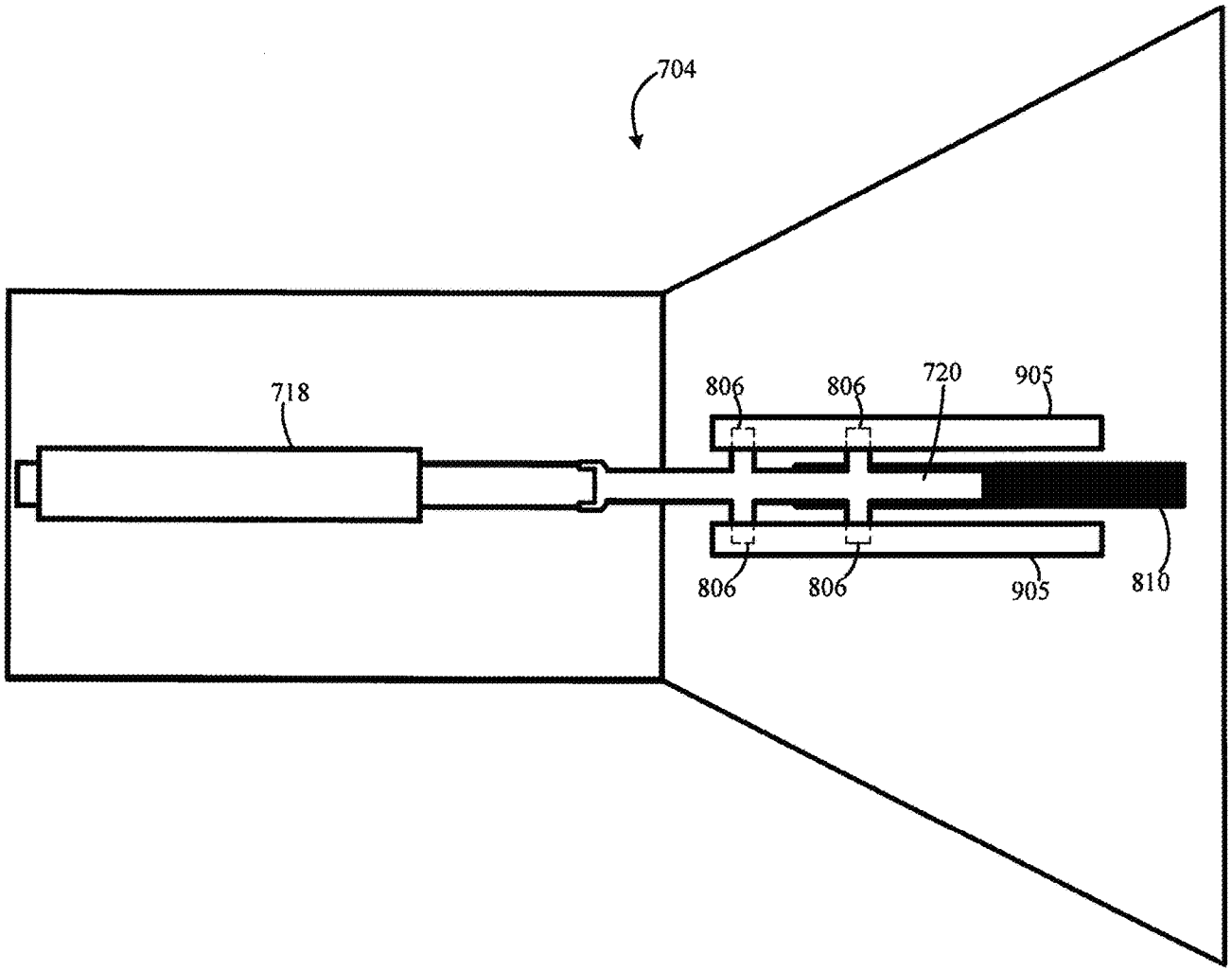
FIG. 8 is a first exploded view of the first means for transporting dredge from a dredging vessel to a barge according to embodiments of the present disclosure.
Figure 9:
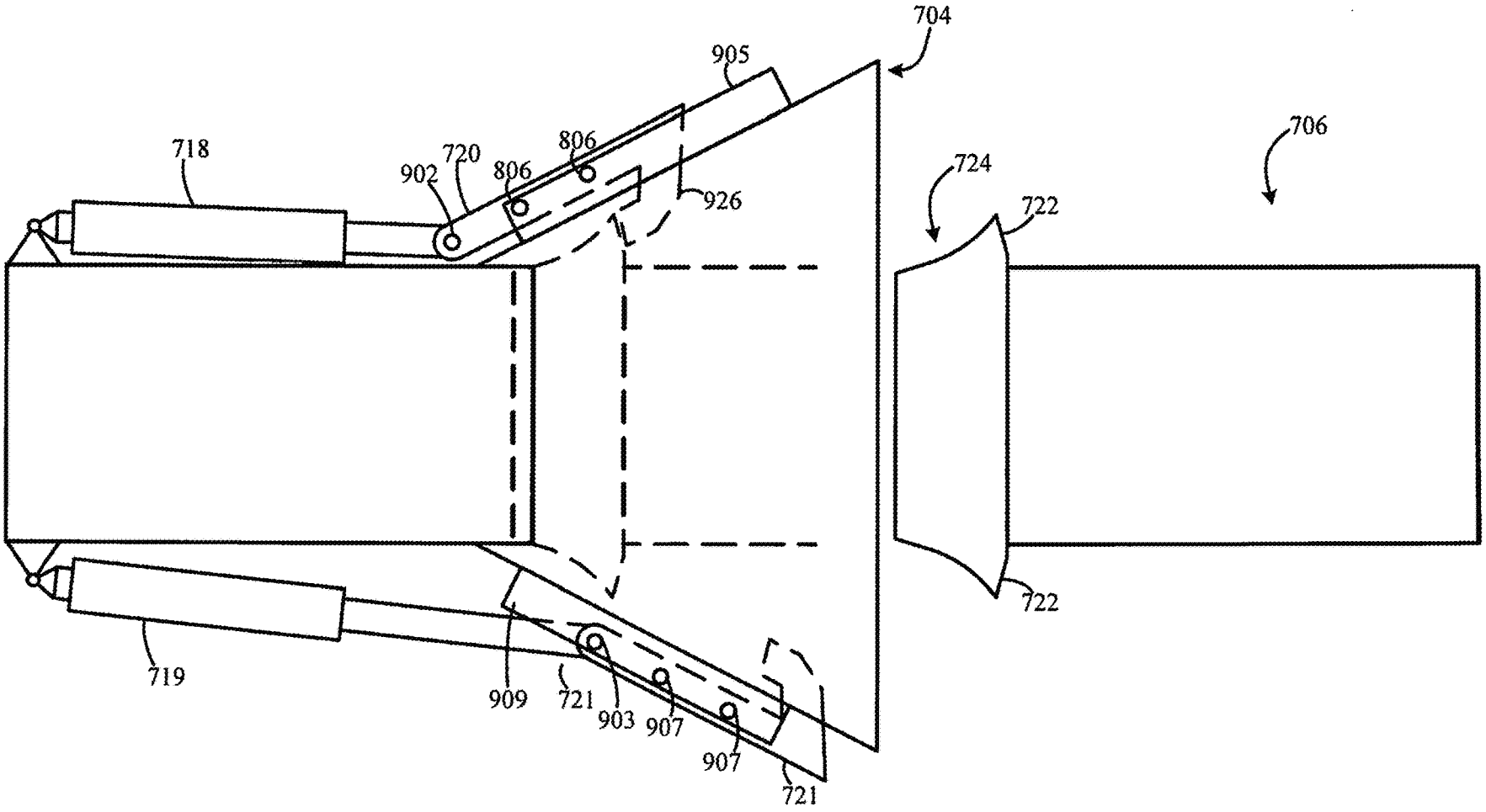
FIG. 9 is a second exploded view of the first means for transporting dredge from a dredging vessel to a barge according to embodiments of the present disclosure.

FIGS. 7 through 9 illustrate a first means for transporting dredge from the dredging vessel 100 to the barge 500. The first means includes a first elongated member 700 located on the dredging vessel 100. The first elongated member 700 receives dredge from the drag arm 116, either directly or indirectly. The first elongated member 700 includes a flexible portion 702 and an end portion 704. The flexible portion 702 may be a flexible tube, such as one offered by Trelleborg, located in the Netherlands. The end portion 704 may be conical, with a minor/smaller opening located at a first end of the end portion 704 that couples to the flexible portion 702 and a major/larger opening located at a second end of the end portion 704 distal from the flexible portion 702 with respect to the end portion 704.

A structure 712 (e.g., an A-frame or other shaped structure) may be located on the bow portion of the dredging vessel 100 to support the first elongated member 700, and more specifically the flexible portion 702. The structure 712 may include one or more davit winches 714. Each davit winch 714 may include a wire 716 that runs through a portion (e.g., one or more pulleys) of the structure 712 and that couples to the first elongated member 700. The wire(s) 716 may couple to the flexible portion 702 of the first elongated member 700, the end portion 704 of the first elongated member 700, or some other location of the first elongated member 700.

The first means also includes a second elongated member 706 located on the barge 500. The second elongated member 706 receives dredge from the first elongated member 700. Thus, the second elongated member 706 may be in fluidic communication with the drag arm 116 via the first elongated member 700. The second elongated member 706 includes one or more hydraulically actuated doors 602 that permit and prevent dredge from being communicated from the second elongated member 706 to a capture area of the barge 500. At least one hydraulically actuated door 602 may be located on an underside of the second elongated member 706.

The second elongated member 706 may releasably couple within a conical portion of the end portion 704 of the first elongated member 700. The end portion 704 may include a first hydraulic actuator 718 and a second hydraulic actuator 719. Each hydraulic actuator (718/719) may be operated by a mechanical or electronic mechanism.

The first hydraulic actuator 718 may be coupled to a first clamping mechanism 720 via a first fastener, such as a first pin 902. The second hydraulic actuator 719 may be coupled to a second clamping mechanism 721 via a second fastener, such as a second pin 903. A hydraulic actuator (718/719) may operate a respective clamping mechanism (720/721) between an open position (e.g., the second hydraulic actuator 719 and the second clamping mechanism 721 in FIG. 9) and a closed position (e.g., the first hydraulic actuator 718 and first clamping mechanism 720 in FIG. 9). When in the open position, a clamping mechanism (720/721) is proximate to the major opening of the conical portion of the end portion 704. Moreover, when in the open position, a clamping mechanism (720/721) is not coupled to the second elongated member 706. When in the closed position, a clamping mechanism (720/721) is further away from the major opening of the conical portion of the end portion 704 than when the clamping mechanism (720/721) is in the open position. Moreover, when in the closed position, a clamping mechanism (720/721) may engage a protruding edge 722 of an end portion of the second elongated member 706, resulting in the second elongated member 706 being coupled to the conical portion of the end portion 704. The end of the second elongated member 706, which couples to the first elongated member 700, may have a convex portion 724 (or other shaped portion having a smaller diameter than the end portion 704 of the first elongated member 700) that mates, or substantially mates, with a portion of the first elongated member 700.

The first clamping mechanism 720 may couple, via at least one pin 806, to a first groove located in or through elongated members 905 coupled to the conical end portion 704. The second clamping mechanism 721 may couple, via at least one pin 907, to a second groove located in or through elongated members 909 coupled to the conical end portion 704. As a hydraulic actuator (718/719) is actuated, a pin(s) (806/907) may be moved within a groove. Movement of a pin(s) (806/907) within a groove causes a respective clamping mechanism (720/721) to actuate between the open position and the closed position and, by extension, engage and disengage the convex portion 724 of the second elongated member 706.

The first clamping mechanism 720 may include a hook portion 926 that extends through an elongated aperture 810 located through the conical end portion 704. As the first clamping mechanism 720 is actuated, the hook portion 926 moves along the elongated aperture 810 between the open position and the closed position. The second clamping mechanism 721 may include a similar hook portion that extends through a similar elongated aperture located through the conical end portion 704.

Figure 10:
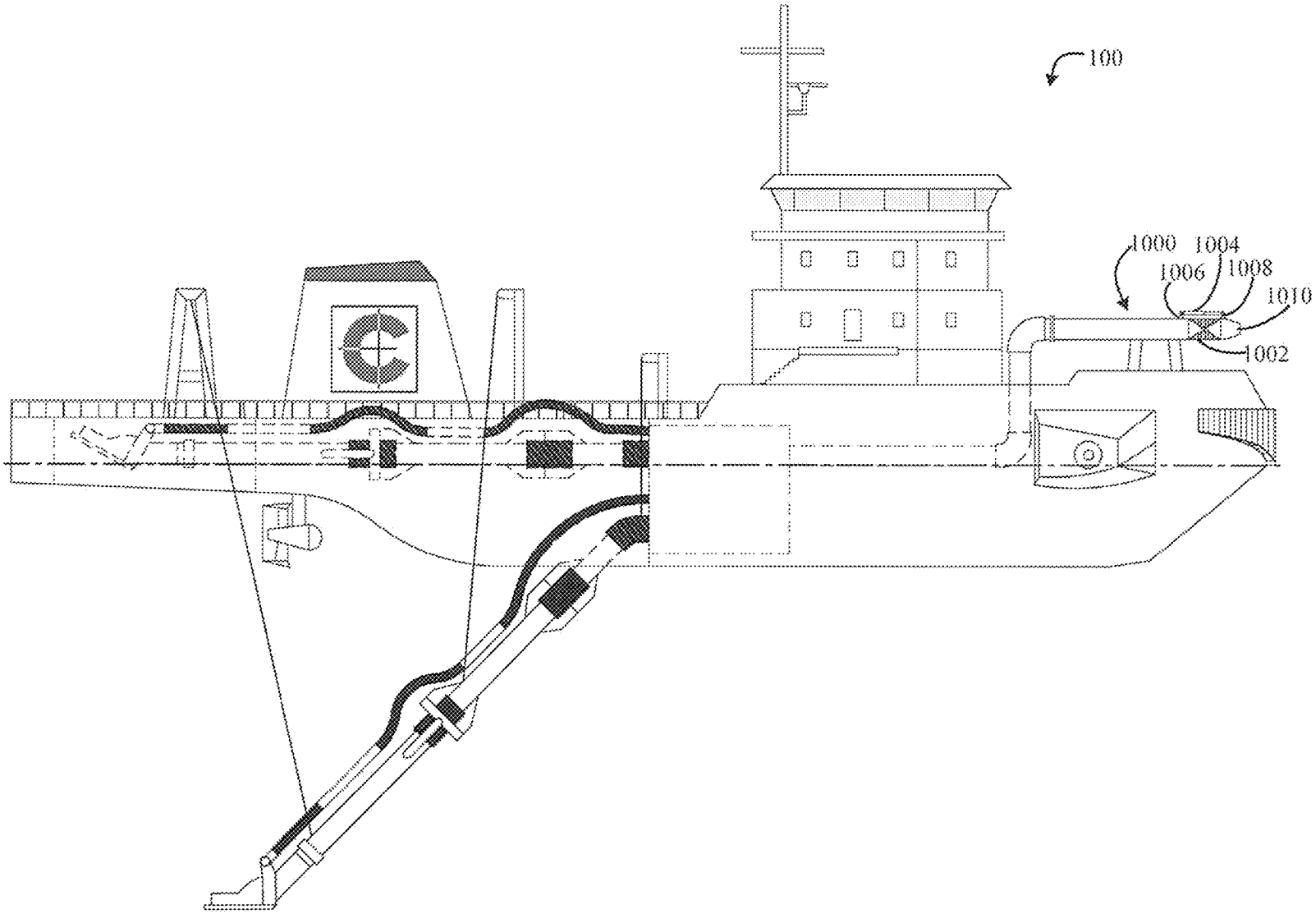
FIG. 10 is a side view of a dredging vessel including a second means for transporting dredge from a dredging vessel to a barge according to embodiments of the present disclosure.
Figure 11:
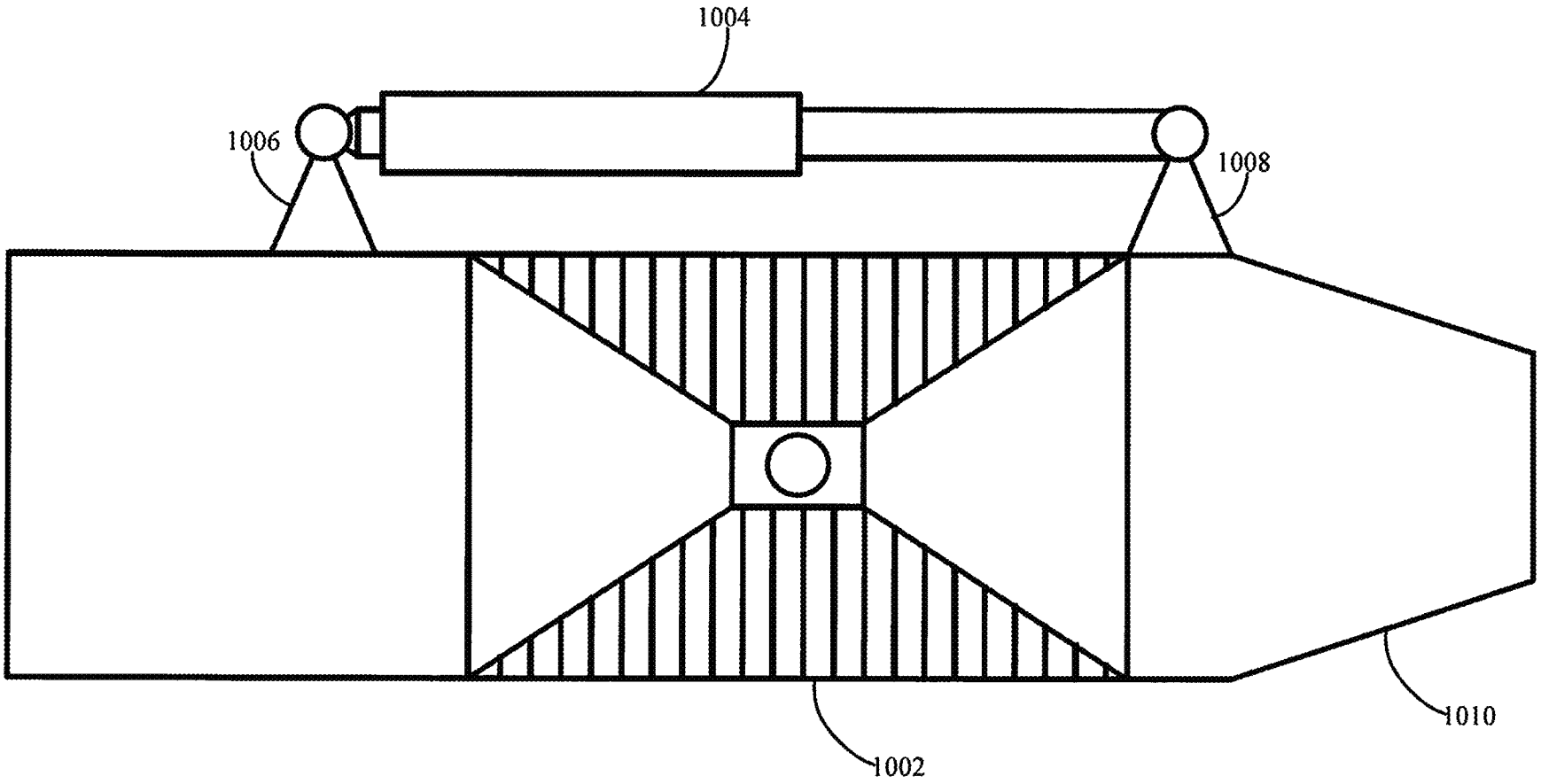
FIG. 11 is an exploded view of the second means for transporting dredge from a dredging vessel to a barge according to embodiments of the present disclosure.

FIGS. 10 and 11 illustrate a second means for transporting dredge from the dredging vessel 100 to the barge 500. The second means includes an elongated member 1000 in fluidic communication with the drag arm 116 such that dredge may be passed from the drag arm 116 and through the elongated member 1000 to the barge 500.

The elongated member 1000 may include one or more flexible joints 1002 that enable the elongated member 1000 to provide dredge, received from the drag arm 116, to the barge 500. A flexible joint 1002 may be mechanically actuated by an actuator 1004. A flexible joint 1002 may be flanked by connections points. For example, the elongated member 1000 may include a first connection point 1006 proximate to a first end of a flexible joint 1002 and a second connection point 1008 proximate to a second end of the flexible joint 1002. The actuator 1004 may couple to the first connection point 1006 and the second connection point 1008. The actuator 1004 may operate on the flexible joint 1002, and more particularly the first connection point 1006 and the second connection point 1008, causing an angle of the elongated member 1000 to change, and resulting in the elongated member 1000 providing dredge to different locations of the barge 500.

The elongated member 1000 may include a reduction nozzle 1010. The elongated member 1000 may or may not include a flexible joint 1002 proximate to the reduction nozzle 1010. Additionally, the elongated member 1000 may or may not include a material deflector that operates on dredge output by the reduction nozzle 1010 and further controls where dredge is communicated to within the barge 500.

As described, the second means may be used to transport dredge to the barge 500. One skilled in the art will also appreciate that the second means may be used for side casting. "Side casting" involves the second means dispensing dredge to a side of a channel rather than the barge 500. Dispensing dredge to a side of a channel allows a depth of the channel to be maintained. The second means may be used to side cast when the dredging vessel 100 is coupled to a barge 500 as well as when the dredging vessel 100 is not coupled to a barge 500.

While the present invention has been particularly described in conjunction with specific embodiments, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

What is claimed is:

1. A dredging system comprising:

a vessel configured for trailing suction dredging, the vessel comprising:

a hull including a bottom, bow portion, stern portion, port side and starboard side;

a deck supported by the hull;

a pump system mounted within the hull;

a drag arm pivotably coupled to the pump system, the drag arm including a drag head configured to dredge an underwater surface while the vessel is underway; and a void defined by contiguous watertight walls or bulkheads joined to and extending between a first contiguous aperture in the bottom of the hull and a second contiguous aperture in the deck, wherein the first contiguous aperture and the void are dimensioned to accommodate pivoting of the drag arm from a raised position to a lowered position, the drag head being within the void when in the raised position, the lowered position being an active dredging position.

2. The dredging system of claim 1, wherein the drag arm is located within the void when in the raised position.

3. The dredging system of claim 1, wherein the vessel further comprises:

a port control mechanism located on a port portion of the deck, the port control mechanism including a first wire coupled to the drag arm, the first wire extending through the void when dredging; and a starboard control mechanism located on a starboard portion of the deck, the starboard control mechanism including a second wire coupled to the drag arm, the second wire extending through the void when dredging.

4. The dredging system of claim 3, wherein:

the first wire and the second wire are coupled to the drag arm at a location proximate to the drag head.

5. The dredging system of claim 3, wherein the void includes an elongated portion extending along a port-starboard axis of the vessel, the elongated portion including a port portion and a starboard portion, the first wire extending through the port portion, the second wire extending through the starboard portion.

6. The dredging system of claim 1, wherein the contiguous void includes an elongated portion extending along a bow-stern axis of the vessel.

7. The dredging system of claim 6, wherein the vessel further comprises:

a mechanism for raising and lowering the drag arm, the mechanism coupling to the drag arm through the void.

8. The dredging system of claim 7, wherein:

the drag arm includes a flexible joint, and the mechanism couples to one of:

the flexible joint, or a location of the drag arm proximate the flexible joint, wherein raising of the drag arm by the mechanism increases an angle of the drag head, wherein lowering of the drag arm by the mechanism decreases an angle of the drag head.

9. The dredging system of claim 1, further comprising:

a barge releasably coupled to the vessel, the barge being in fluidic communication with the drag arm.

10. The dredging system of claim 9, wherein the vessel is releasably coupled to the barge by at least one articulated tug/barge (AT/B) connector.

11. The dredging system of claim 9, wherein a bow portion of the vessel releasably couples to a stern portion of the barge.

12. The dredging system of claim 9, wherein the barge includes a concave recess located in a stern portion of the barge, the concave recess receiving a convex portion of a bow portion of the vessel.

13. The dredging system of claim 9, wherein:

the vessel includes a first elongated member in fluidic communication with the drag arm, the first elongated member including a flexible portion and an end portion; and the barge includes a second elongated member releasably coupled to the end portion of the first elongated member, the second elongated member including a hydraulically actuated door for providing the barge with spoils captured by the drag arm.

14. The dredging system of claim 13, wherein the flexible portion is coupled to an A-frame structure via a plurality of winch-connected guide wires.

15. The dredging system of claim 13, wherein:

the end portion of the first elongated member is conical; and an end portion of the second elongated member releasably couples within the end portion of the first elongated member.

16. The dredging system of claim 15, wherein the end portion of the first elongated member includes a hydraulic actuator that releasably couples the end portion of the first elongated member to the end portion of the second elongated member.

17. The dredging system of claim 16, wherein the hydraulic actuator is operated via one of a mechanical or electronic mechanism.

18. The dredging system of claim 16, wherein the hydraulic actuator is coupled to a clamping mechanism, the clamping mechanism being coupled to grooves of elongated components, actuation of the hydraulic actuator causing the clamping mechanism to move within the grooves, the clamping mechanism moving within the grooves causing the clamping mechanism to releasably engage and disengage the end portion of the second elongated member.

19. The dredging system of claim 9, wherein the vessel includes an elongated member in fluidic communication with the drag arm, the elongated member including a flexible portion that enables the elongated member to provide spoils, captured by the drag arm, to different areas of the barge.

20. The dredging system of claim 19, wherein the flexible portion is flanked by connection points for a hydraulic component.

21. The dredging system of claim 20, wherein the hydraulic component acts on the flexible portion to enable the elongated member to provide the spoils to the different areas of the barge.

22. The dredging system of claim 19, wherein the elongated member includes a reduction nozzle, the reduction nozzle at least partially controlling a location in the barge the spoils are delivered.

23. The dredging system of claim 1, wherein the vessel further includes an elongated member in fluidic communication with the drag arm, the elongated member including a reduction nozzle, the elongated member configured to be articulated to aim spoils, captured by the drag arm, port or starboard of the vessel.

* * * * *